US009403176B2

(12) United States Patent
Townsend et al.

(10) Patent No.: US 9,403,176 B2
(45) Date of Patent: Aug. 2, 2016

(54) STREAM DEFLECTOR

(71) Applicant: Nelson Irrigation Corporation, Walla Walla, WA (US)

(72) Inventors: Michael Townsend, Waitsburg, WA (US); Craig B. Nelson, Walla Walla, WA (US)

(73) Assignee: NELSON IRRIGATION CORPORATION, Walla Walla, WA (US)

( * ) Notice: Subject to any disclaimer, the term of this patent is extended or adjusted under 35 U.S.C. 154(b) by 204 days.

(21) Appl. No.: 14/036,600

(22) Filed: Sep. 25, 2013

(65) Prior Publication Data

US 2015/0083827 A1 Mar. 26, 2015

(51) Int. Cl.
*B05B 3/08* (2006.01)
*B05B 1/26* (2006.01)

(52) U.S. Cl.
CPC ..... *B05B 3/085* (2013.01); *B05B 1/267* (2013.01)

(58) Field of Classification Search
CPC ..... B05B 1/262; B05B 1/265; B05B 1/267; B05B 3/085; B05B 3/08; B05B 1/26; B05B 3/082; B05B 3/087
USPC ..... 239/231, 232, 288.5, 498, 499, 521, 239/523, 501, 518, 522, 524, 598, DIG. 1
See application file for complete search history.

(56) References Cited

U.S. PATENT DOCUMENTS

| | | | | | |
|---|---|---|---|---|---|
| 533,367 | A | * | 1/1895 | McBoyle | 239/510 |
| 612,433 | A | * | 10/1898 | Orford | 239/516 |
| 691,758 | A | | 1/1902 | Gay | |
| 1,763,119 | A | * | 6/1930 | Archer | 239/275 |
| 2,087,139 | A | * | 7/1937 | Cameron | 361/215 |
| 2,324,725 | A | * | 7/1943 | Rich | 4/665 |
| 2,639,191 | A | | 5/1953 | Hruby, Jr. | |
| 3,009,652 | A | * | 11/1961 | McKay | 239/231 |
| 4,168,033 | A | * | 9/1979 | von Bernuth | B05B 1/267 239/523 |
| 4,191,331 | A | * | 3/1980 | Bivens et al. | 239/231 |
| 4,461,423 | A | | 7/1984 | Davis | |
| 5,031,835 | A | | 7/1991 | Rojas | |
| 6,336,599 | B1 | | 1/2002 | Herr et al. | |
| 7,066,404 | B1 | | 6/2006 | Kollar | |
| 2007/0221758 | A1 | | 9/2007 | Won | |
| 2013/0020409 | A1 | | 1/2013 | Bartlett | |

* cited by examiner

*Primary Examiner* — Len Tran
*Assistant Examiner* — Cody Lieuwen
(74) *Attorney, Agent, or Firm* — Nixon & Vanderhye P.C.

(57) ABSTRACT

A stream redirecting device for a sprinkler includes a shell-shaped body having a generally semi-circular shape in plan, with opposite inlet and outlet side edges. The body extends outwardly and upwardly from a base at a lower end and then upwardly and inwardly to a distal, arcuate edge at an upper end. An inside surface of the shell-shaped body is formed with a plurality of grooves between the inlet side edge and the outlet side edge, extending in a generally radial direction with entry ends adjacent the base and exit ends at the distal, arcuate edge. The grooves are formed with circumferential exit angles that vary substantially uniformly in opposite directions from a center one of the plurality of grooves to first and last of the plurality of grooves at the opposite inlet and outlet side edges, respectively.

20 Claims, 14 Drawing Sheets

STREAM DEFLECTOR

BACKGROUND

This invention relates to rotary irrigation sprinklers and specifically, to a stream deflector that limits the distribution of a stream emitted by the sprinkler spray plate to less than the 360-degree circle pattern that would otherwise be irrigated by the stream.

In agricultural irrigation systems, rotary-type sprinklers are used to irrigate large areas of land; and for much of the interior portions of the field to be irrigated, a full 360-degree circular pattern is used with good results. There are instances, however, where one or more sprinklers are located close to the edge of the field, for example, along a roadway, where it is desired to limit the normal 360-degree (or full-circle) pattern of the one or more sprinklers to avoid undesirable and wasteful watering of the roadway (or other structure(s) along the edge of the field).

There are, of course, mechanically and/or electrically reversible sprinklers with adjustable stops to achieve a desired arcuate pattern, less than full circle. In addition, simple "road guards" or other stream deflectors have been employed to inhibit a full-circle pattern by deflecting the stream emitted by the sprinkler spray plate back onto the field within a limited portion of the rotation of the spray plate. In one example, the deflector is attached to a rotary sprinkler, and includes a substantially semi-circular, generally concave shell formed with grooves on its interior (concave) surface that receive and redirect the stream back towards the area just watered, thus protecting the area behind the sprinkler from the emitted stream (see U.S. Pat. No. 4,191,331).

A problem associated with deflectors similar to that described in the '331 patent is that the redirected stream is not uniformly distributed over the remaining pattern area exposed to the stream. By way of example, if the full-circle, normal pattern area is to be reduced to a half-circle pattern, a uniformity problem arises that is related to the groove configuration on the deflector. As will be explained further herein in connection with FIG. 14, the deflector grooves lie on a radius drawn on or near an imaginary center of the arcuate deflector (that may correspond to the sprinkler spray plate axis), and the grooves are substantially straight in a radial direction from their inlet ends, through the concave portion of the deflector shell, to their outlet ends. As a result, a stream entering the inlet side edge of the deflector, to the left of center as the nozzle rotates, is redirected generally toward the outlet side of the deflector, but the outlet stream traces a line angled away from the outlet side edge of the deflector. Similarly, as the stream moves across and within the deflector grooves, eventually impinging on the last groove on the outlet side of the deflector, the stream is redirected back toward the inlet side but, again, tracing a line angled away from the inlet side edge of the deflector. As a result, there are angled or wedge-shaped gaps extending from opposite sides of the deflector that do not receive redirected water, while the center area between these two gaps, is watered by the redirected stream, resulting in an unacceptable lack of uniformity across the area directly in front of the sprinkler/deflector.

There remains a need therefore, for a simple, easy-to-install, and inexpensive road guard or deflector that substantially eliminates or at least minimizes the nonuniformity issue associated with prior road guards or deflectors.

BRIEF SUMMARY OF THE INVENTION

In accordance with a first exemplary but nonlimiting embodiment, the invention provides a stream deflector for a sprinkler comprising a generally concave, shell-shaped body having a generally semi-circular shape in plan, with opposite inlet and outlet side edges, the body extending outwardly and upwardly from a base at a lower end and then upwardly and inwardly to a distal, arcuate edge at an upper end, with a maximum radius between the base and a distal, arcuate edge; an inside surface of the shell-shaped body formed with a plurality of grooves between the inlet side edge and the outlet side edge, extending in a generally radial direction with entry ends adjacent the base and exit ends at the distal, arcuate edge; and wherein the grooves are formed with circumferential exit angles that vary substantially uniformly in opposite directions from a center one of the plurality of grooves to first and last of the plurality of grooves at the opposite inlet and outlet side edges, respectively.

In another aspect, the invention relates to a sprinkler comprising a housing assembly supporting a rotatable spray plate provided with a stem adapted to emit a stream in a substantially radially outward and upward direction when the spray plate rotates about an axis; and a stationary stream deflector separably mounted on the housing assembly, the stream deflector provided with a shell-shaped body having a generally semi-circular shape in plan, with opposite inlet and outlet side edges, the body extending outwardly and upwardly from a base at a lower end and then upwardly and inwardly to a distal, arcuate edge at an upper end, and having a maximum radius between the base and the distal, arcuate edge; an inside surface of the shell-shaped body formed with a plurality of grooves extending substantially radially between the inlet side edge and the outlet side edge, with entry ends adjacent the base and exit ends at the distal, arcuate edge; the entry ends of the grooves located to sequentially receive the stream emitted from the spray plate as the spray plate rotates about the axis; and wherein the grooves are formed with circumferential exit angles that vary substantially uniformly in opposite directions from a center one of the plurality of grooves to first and last of the plurality of grooves at the opposite inlet and outlet side edges, respectively.

In another aspect the invention relates to a stream deflector for a sprinkler comprising a substantially concave shell-shaped body provided with a plurality of generally radially-extending grooves between inlet and outlet side edges of the shell-shaped body, wherein at least a first and last of said generally radially-extending grooves are shaped to redirect streams back across the shell-shaped body, substantially parallel to a vertical plane extending across said shell-shaped body, adjacent, and substantially equally spaced from, said inlet and outlet side edges.

DETAILED DESCRIPTION OF THE INVENTION

Figure 1:
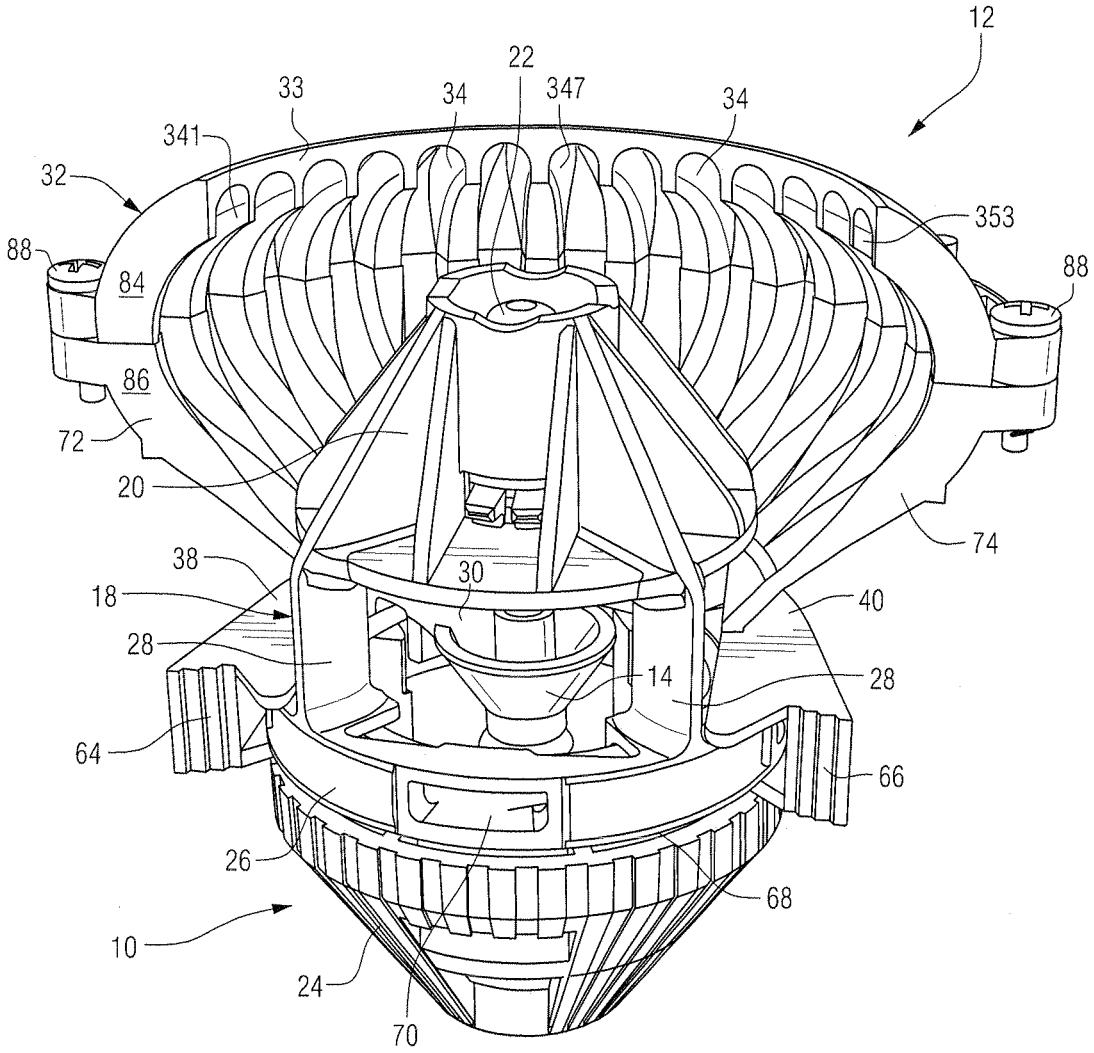
FIG. 1 is a perspective view of a rotary sprinkler supporting a deflector device in accordance with an exemplary but non-limiting embodiment of the invention.

FIG. 1 illustrates a rotary-type sprinkler 10 supporting a stream deflector 12 in accordance with an exemplary but nonlimiting embodiment of the invention. The sprinkler 10 includes a rotatable spray plate 14 supported on a shaft 16 (FIGS. 5, 6 and 9) that is received within a first sprinkler housing 18. The first housing 18 includes an upper portion 20 which encloses and supports a viscous brake 22 to slow the rotation of the shaft 16 and the spray plate 14 in a well-known manner (see, e.g., commonly-owned U.S. Pat. No. RE 33,823). The sprinkler 10 also includes a second housing 24 provided with internal threads by which the sprinkler can be mounted on, for example, a riser secured to a mobile irrigator (not shown). The second housing 24 also mounts a nozzle (not shown) that aligns and engages the spray plate 14 upon assembly of the first and second housings. In that regard, a lower annular ring 26 of the first housing 18 connects to the upper portion 20 via a plurality (four in the exemplary embodiment) of struts 28, and is configured to enable a "push-and-turn" attachment to the second housing 24 in a known manner.

Figure 5:
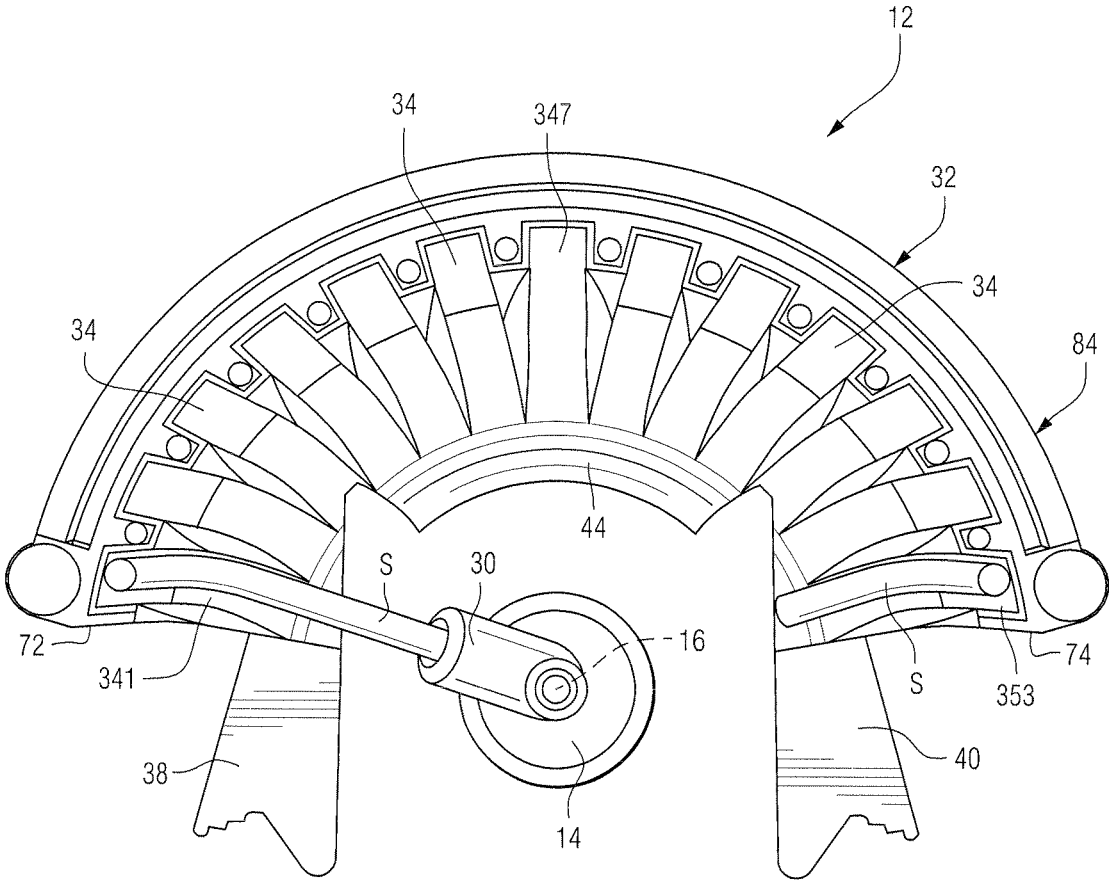
FIG. 5 is a partial, simplified plan view of the deflector shown in FIGS. 1-3, with an upper portion of the deflector removed to better illustrate the lower ends of the deflector grooves.

As best appreciated from FIG. 5, the offset configuration of the spray plate stem 30 causes the spray plate 14 and shaft 16 to rotate about the axis of the shaft when water is emitted from the spray plate. In this exemplary and well-known sprinkler construction, the spray plate 14 emits a single stream in a radially outward and upward direction as it rotates with the shaft 16, the stream passing through the spaces created by the struts 28.

Figure 2:
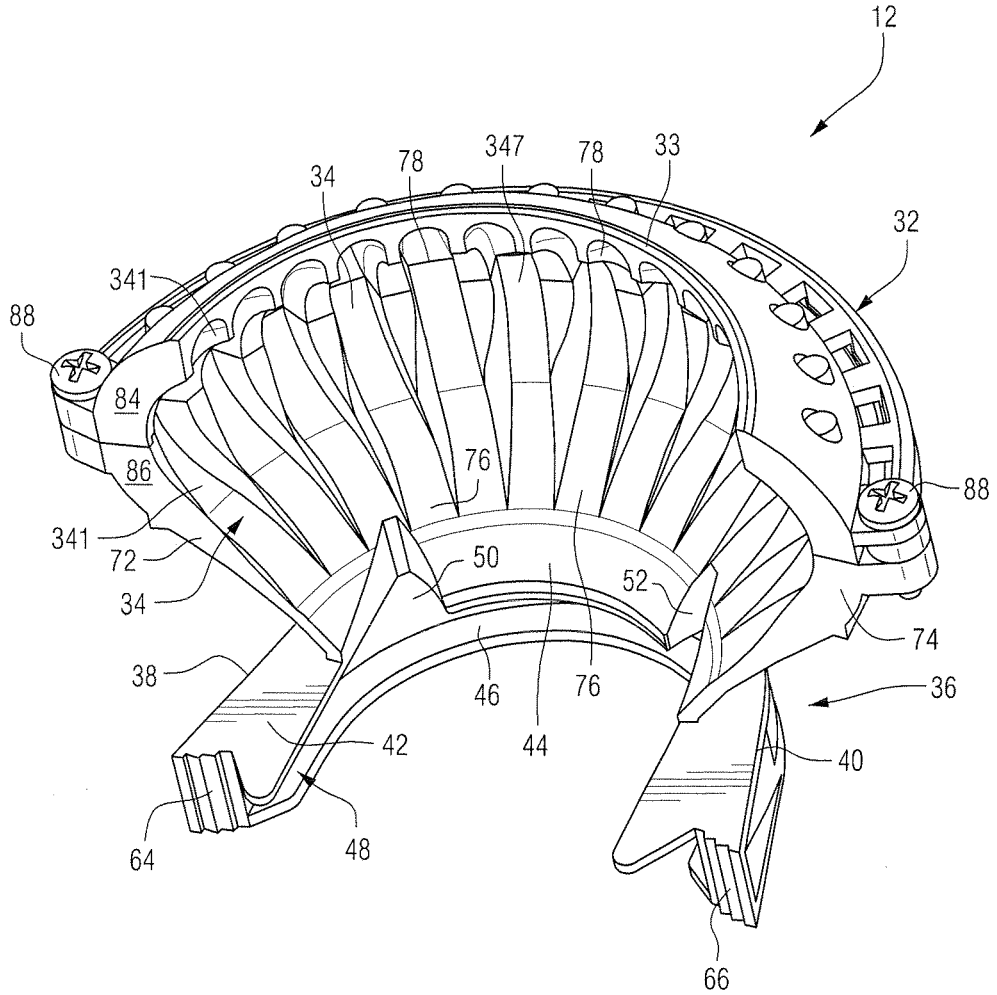
FIG. 2 is a perspective view of the deflector shown in FIG. 1, removed from the sprinkler.
Figure 3:
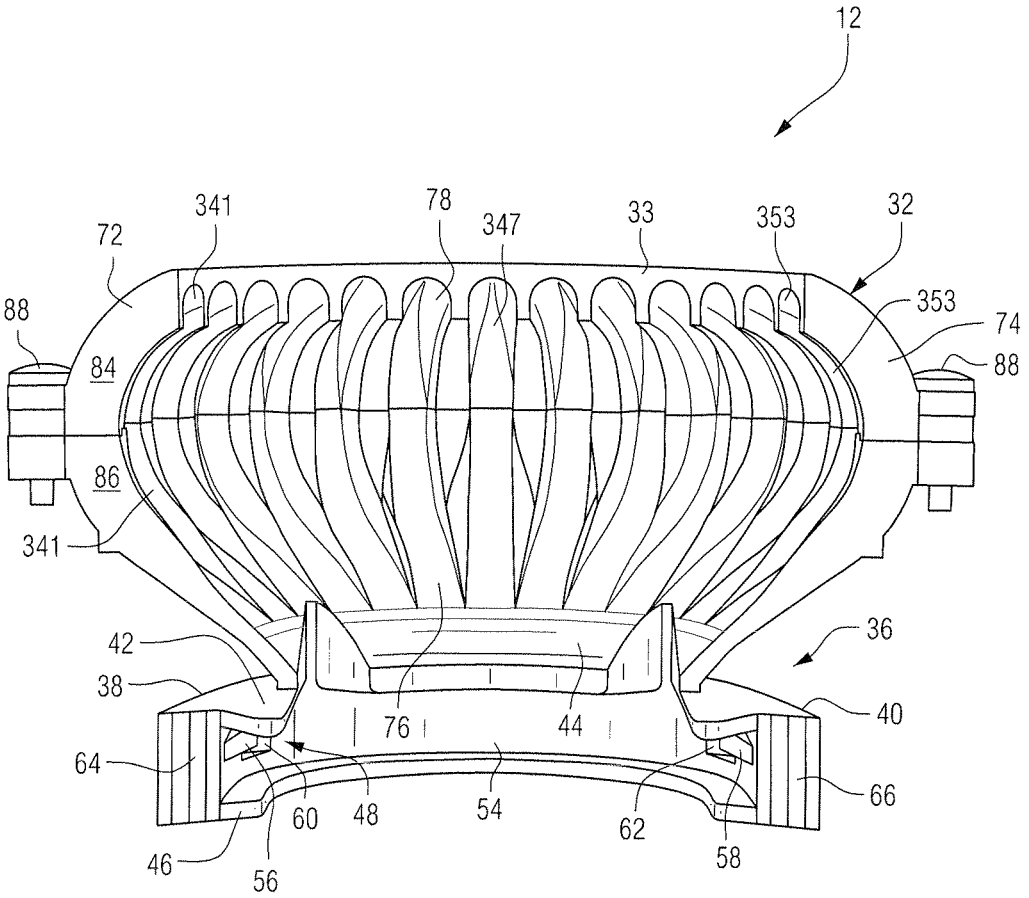
FIG. 3 is a front elevation of the deflector shown in FIGS. 1 and 2.

With further reference to FIG. 2, the stream deflector 12 includes an open-topped dome or shell 32 (also referred to as a generally concave, shell-shaped body) formed with interior grooves 34 that redirect the stream emitted from the spray plate stem 30. The deflector 12 is also formed with a substantially semi-circular base 36 incorporating flexible arms 38, 40 extending away from the deflector dome or shell 32. The upper edge of the base 36 is formed with an inwardly directed flange 42 that merges into a solid, non-grooved base portion 44 of the shell 32, and the lower edge of the base is formed with an inwardly directed flange 46, thus forming an inwardly-facing and substantially U-shaped slot 48 within the base 36. The non-grooved base portion 44 of the shell 32 is interrupted by a pair of notches 50, 52, the purpose for which will be described further below. The vertical wall 54 of the slot is formed with inwardly directed, tapered tabs 56, 58 and adjacent apertures 60, 62, respectively (FIG. 3). The arms 38, 40, terminate at their respective distal ends with ribbed, angled surfaces 64, 66 adapted to be engaged by a user's fingers when removing the deflector from the sprinkler as described further herein.

To attach the deflector 12 to the sprinkler 10, the lower flange 46 of the deflector is aligned with a peripheral, annular slot 68 (FIGS. 1 and 9) at the interface of the first and second housings 18, 24 of the sprinkler 10, and loosely pushed into the slot until resistance is felt where the tapered tabs 56, 58 engage the lower annular ring 26. Note that the ring 26 is provided with four, equally spaced apertures 70 (one visible in each of FIGS. 1 and 9). Continued lateral pushing of the deflector 12 will cause the arms 38, 40 to flex outwardly as the tapered tabs 56, 58 ride over the ring 26 and snap into two of the apertures 70. Approximately half of the ring 26 is now seated within the slot 48, with two of the struts 28 seated in notches 50, 52, such that the deflector 12 is securely but removably attached to the sprinkler 10. To remove the deflector 12, the user will simply push on the surfaces 64, 66 to flex the arms 38, 40 outwardly to disengage the tabs 56, 58 from the apertures 70, permitting the deflector to be pushed laterally out of engagement with the sprinkler.

Figure 4:
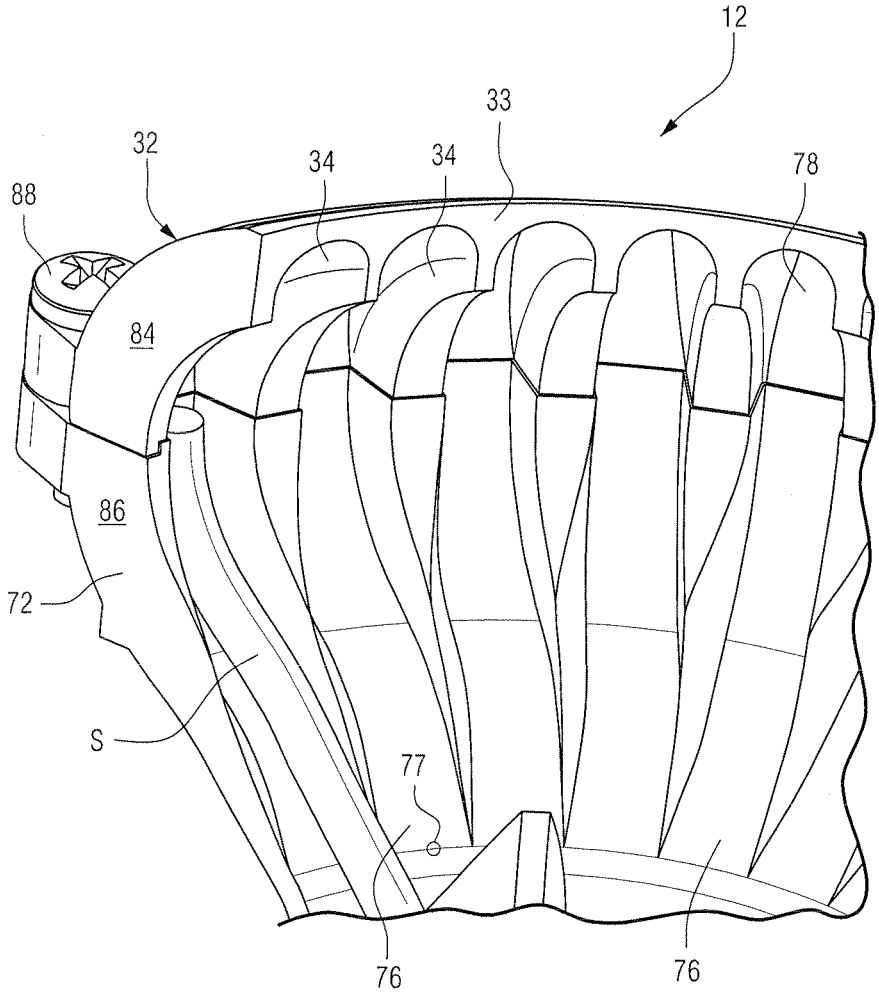
FIG. 4 is a partial, enlarged perspective view of the deflector shown in FIG. 2.

The generally concave, shell-shaped body 32 is formed with a compound-curved surface as best appreciated from FIGS. 1 4), curving upwardly and radially outwardly from a smaller radius at the base 36 (and thus outwardly from the sprinkler axis), and then upwardly and radially inwardly to a larger radius at a peripheral edge 33. Each of the grooves 34, except for a center or mid-point groove 347, follows this contour between entry and exit ends to thereby effectively reverse the direction of the stream as it travels along the deflector grooves as described in greater detail below.

Figure 6:
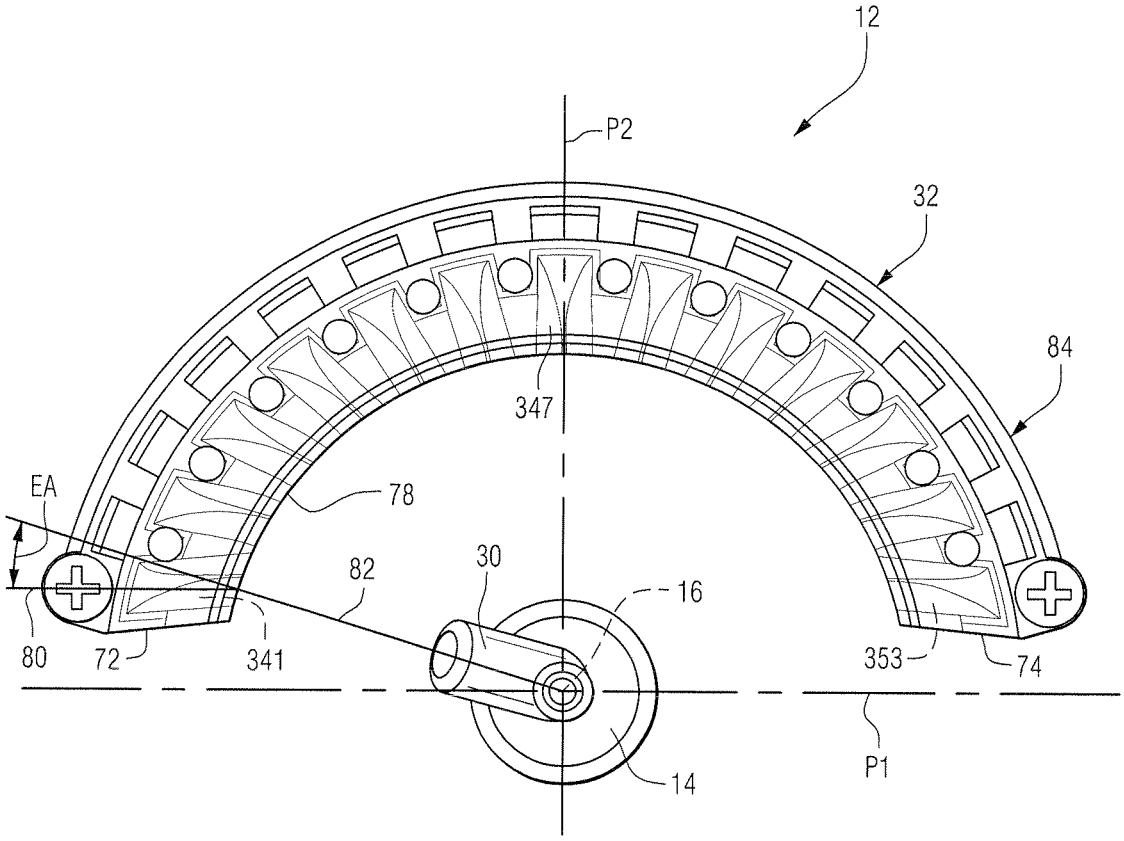
FIG. 6 is a partial, simplified plan view of the deflector shown in FIG. 5, with an upper portion of the outer shell shown in transparency to better illustrate the upper end of the deflector grooves.
Figure 7:
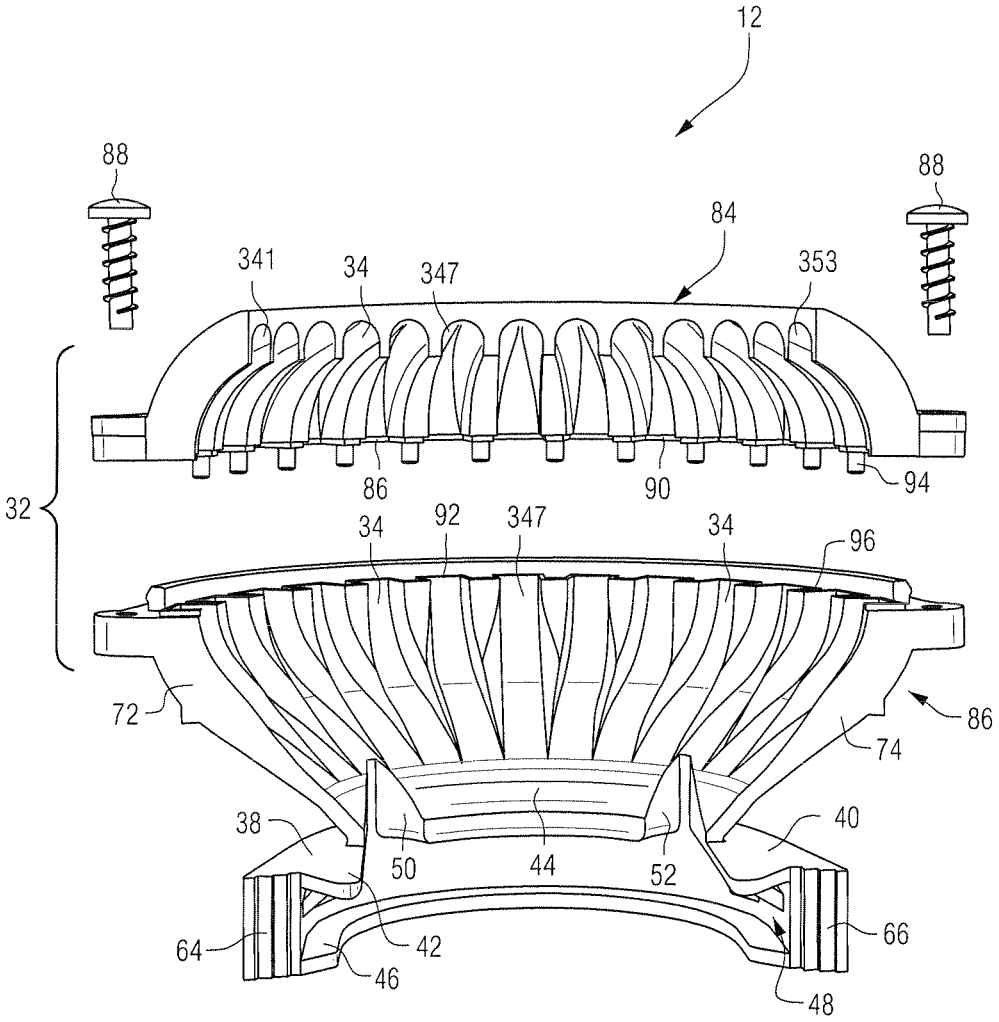
FIG. 7 is an exploded assembly view of the deflector shown in FIG. 3.

In order to facilitate an understanding of specific and important aspects of the groove configuration on the interior side of the shell 32, a vertical reference plane P1 is shown in FIG. 6 (and FIGS. 10-14) extending across the front of the deflector, and through the center axis of the sprinkler, i.e., the axis of the shaft 16. For purposes of this disclosure, reference numeral 16 may be considered as representing the shaft, the shaft axis and the sprinkler axis. A mid-point of the deflector is defined by a second vertical plane P2 extending perpendicularly to plane P1, and also passing through the shaft axis 16. Relative to the plane P1, the deflector extends substantially 170 degrees from an inlet side edge to an outlet side edge 74, the edges each offset from the plane P1 by approximately five degrees. Thus, plane P1 is also parallel to (and equally spaced from) a line connecting the inlet and outlet side edges 72, 74. To further facilitate the description of the groove configuration, certain of the grooves are separately labelled as grooves 341, 347 and 353 (see, for example, FIGS. 1-7) as explained below.

Between the inlet and outlet side edges 72, 74, respectively, the grooves 34 are arranged to receive a stream exiting the spray plate stem 30 and to redirect the stream back onto the field as the stream moves sequentially through the grooves, from the inlet side edge 72 to the outlet side edge 74. Each groove 34 has an entry end 76 and an exit end 78. In order to avoid overcrowding, reference numerals 76, 78 are used sparingly in FIGS. 2-4, 6 and 8. As described herein, a first groove 341 adjacent the inlet side edge 72 receives the stream S (see FIG. 11) as the spray plate 14 rotates about its axis in a clockwise direction. A seventh, mid-point groove 347 lies in the plane P2. A thirteenth groove 353 adjacent the outlet side edge 74 is the last groove to receive the stream before the stream exits the deflector. All the grooves 34 have substantially the same width dimensions, except for the lead-in edge of the first groove 341 and the lead-out edge of the last groove 353. Each groove also has a circumferential "exit angle", i.e., the angle at which the stream is redirected back onto the field as it exits the groove. As will be explained further below, the exit angles decrease substantially uniformly from the first groove 341 to the mid-point groove 347, and then increase substantially uniformly from the mid-point groove 347 to the last groove 353. In other words, the groove configurations on either side of the mid-point groove 347 are substantially mirror images of each other.

For purposes of this disclosure, and with reference to FIG. 6, the exit angle EA for each groove may be defined by the intersection of a first line 82 passing through the sprinkler axis 16 and a point at the center of the entry end 76 of the groove (see, for example, point 77 in FIG. 4), and a second line 80 extending along the center of the exit end 78 of the groove. This angle may be considered to represent the amount of offset from a straight, radially oriented groove. For the illustrated embodiment, the exit angle will decrease about 16 degrees for each groove, from groove 341 to groove 347 where the exit angle is zero. As noted above, the grooves and respective exit angles to the right of the mid-point groove 347 are a substantial mirror image of the grooves and exit angles to the left of the mid-point groove 347. In order to achieve the desired exit angles, the circumferential curvature of each groove also changes between the entry end and the exit end 78 (see FIGS. 1-6). For the first groove 341 with the largest exit angle, the curvature as defined by the arcuate side surfaces of the groove is more pronounced because it is desirable to maintain a smooth path for the stream as it flows through the groove. Thus the groove 341 curves first in one direction toward the plane P1 (or toward the inlet side edge 72) and then away from the plane P1 (or away from the inlet side edge 72) to finally arrive at the desired exit angle. As the exit angle decreases, the degree of circumferential curvature within each groove also decreases, so that for groove 347, where the exit angle is zero, there is essentially no circumferential curvature in the groove. From groove 347 to groove 353, the curvatures are mirror images of those in grooves 341 to 347.

Referring to FIG. 7, the deflector 12 in the exemplary embodiment is of two-piece construction, with upper and lower portions 84, 86, respectively, joined by two or more screws 88 along facing horizontal edges 90, 92 with the assistance of alignment pins 94 and holes 96 (labeled as such only in FIG. 7, again to avoid overcrowding of reference numerals in the various figures).

Figure 8:
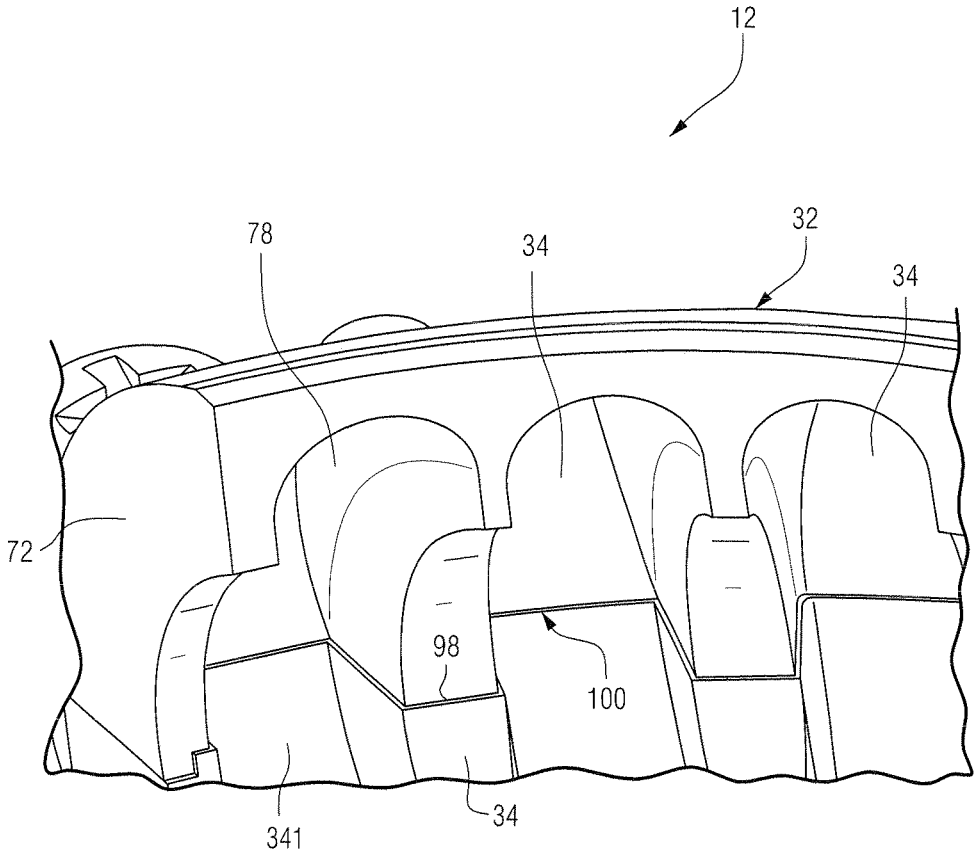
FIG. 8 is another partial enlarged perspective view of the deflector shown in FIG. 2, showing a seam between upper and lower, separable portions of the deflector.

Turning to FIG. 8, it can be seen that the grooves 34 at their exit ends 78, in the upper portion 84, are slightly enlarged relative to the grooves in the lower portion 86, creating a step or shoulder 98 facing outwardly along a seam 100 created by the joined edges 90, 92. This arrangement insures smooth flow of the stream by eliminating the possibility of an inwardly facing shoulder resulting from a slight mismatch of the upper and lower portions 84, 86, that would disturb the exiting stream. Nevertheless, the curvature of the groove side walls carries over from the lower portion to the upper portion, and sets the exit angles for the various grooves.

Figure 9:
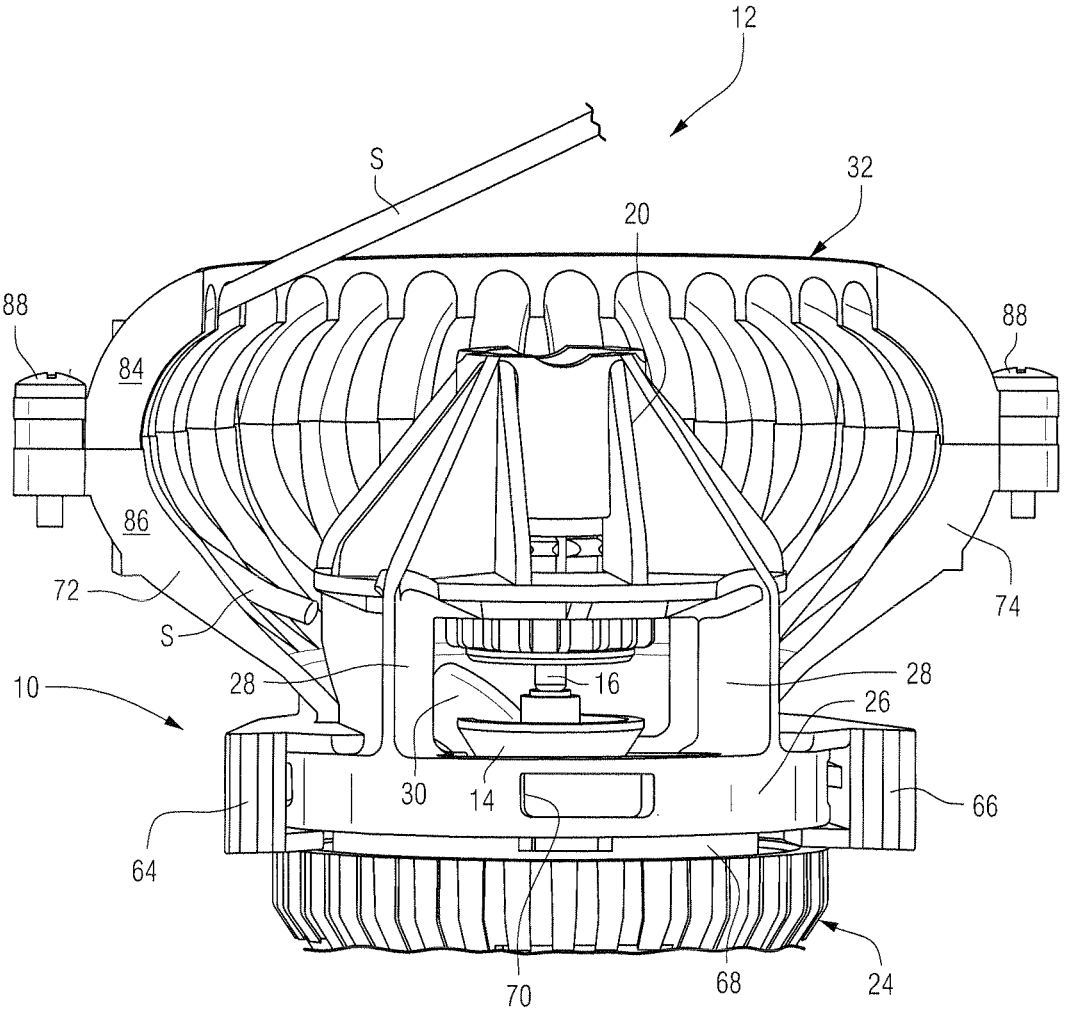
FIG. 9 is a partial front elevation of the sprinkler and deflector shown in FIG. 1, showing generally how a stream emitted from the spray plate is redirected by the deflector.

FIG. 9 illustrates generally the manner in which a stream S emitted by the spray plate stem 30 is redirected back across the sprinkler 10 and onto the field being irrigated. It will be appreciated that the groove shapes in both the upper and lower portions 84, 86 are responsible for the exit angles as defined above. The upper portion 84 also determines the elevation angle of the stream relative to ground.

Figure 10:
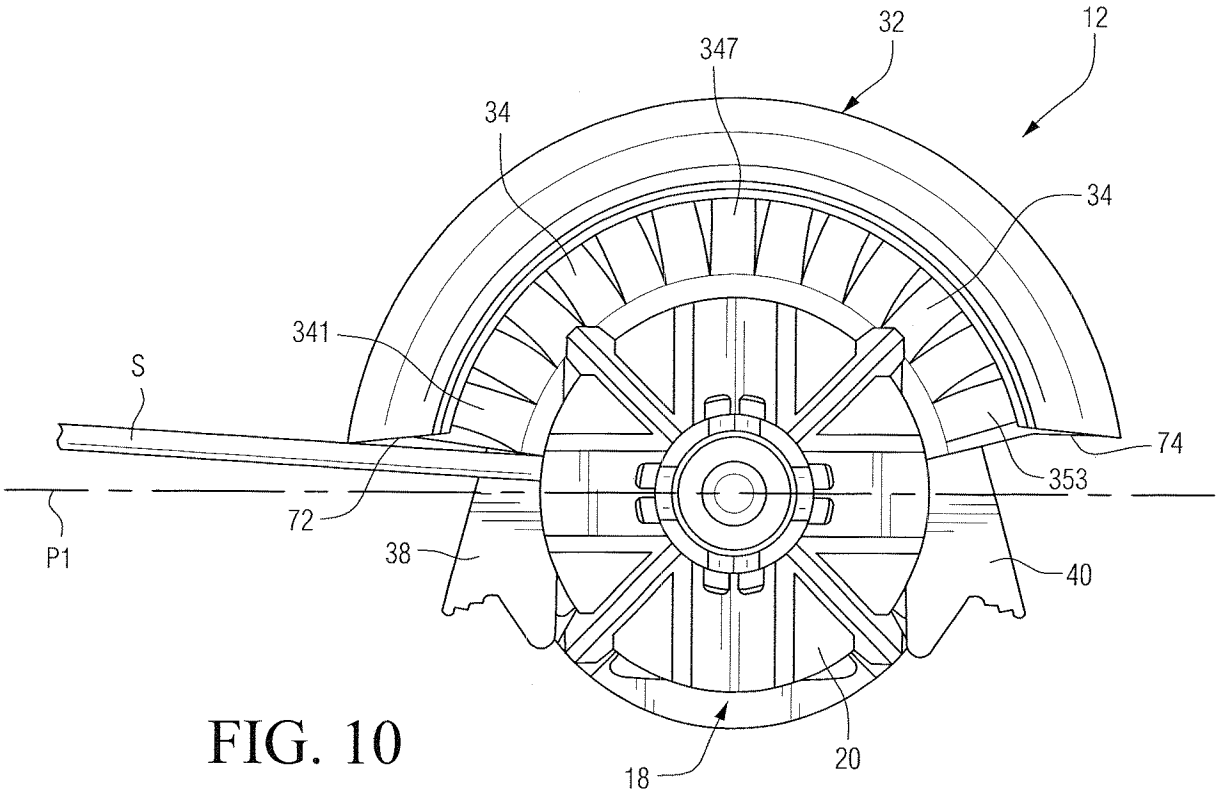
FIG. 10 is a plan view of the deflector attached to a sprinkler, and showing a stream emitted from the sprinkler spray plate just prior to entering the inlet side of the deflector.

The sequence of stream movement through the deflector from the inlet side edge 72 to the outlet side edge 74 will now be described in connection with FIGS. 10-13. FIG. 10 shows the stream S travelling in a clockwise direction, adjacent the inlet side edge 72, about to enter the deflector. Note that the stream extends substantially parallel to and behind the plane P1. If the plane P1 also represents the edge of the field being irrigated, it will be appreciated that a narrow portion of the land or roadway behind the plane/edge will be wetted by the stream. This is intended to be a "safety factor" in that, if an allowance is not made for wind, it is quite likely that some of the field along the edge will not receive any water.

Figure 11:
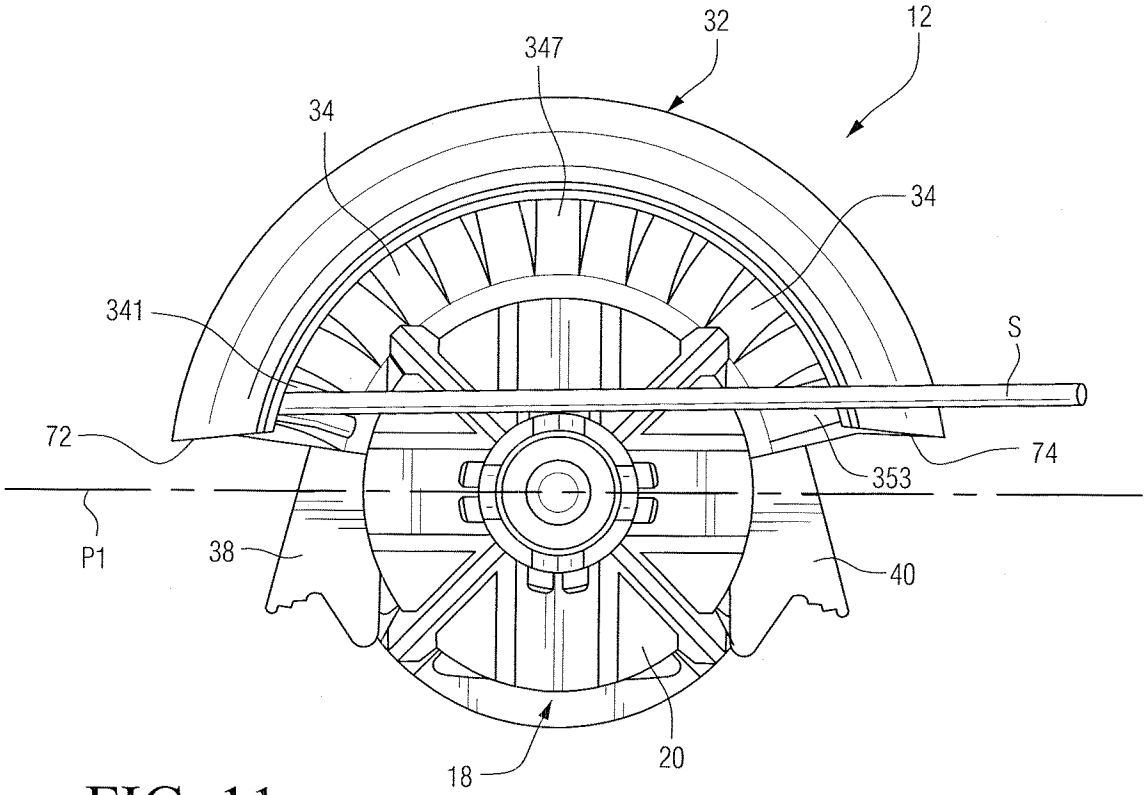
FIG. 11 is a top plan view similar to FIG. 10 but showing the stream now within the first groove on the inlet side of the deflector, and redirected across the outlet side of the deflector.

FIG. 11 shows the stream S entering and exiting the first groove 341; and because of the exit angle established by the groove configuration described above, the stream is redirected across the sprinkler, behind the plane P1, and slightly behind the outlet side edge 74 of the deflector.

Figure 12:
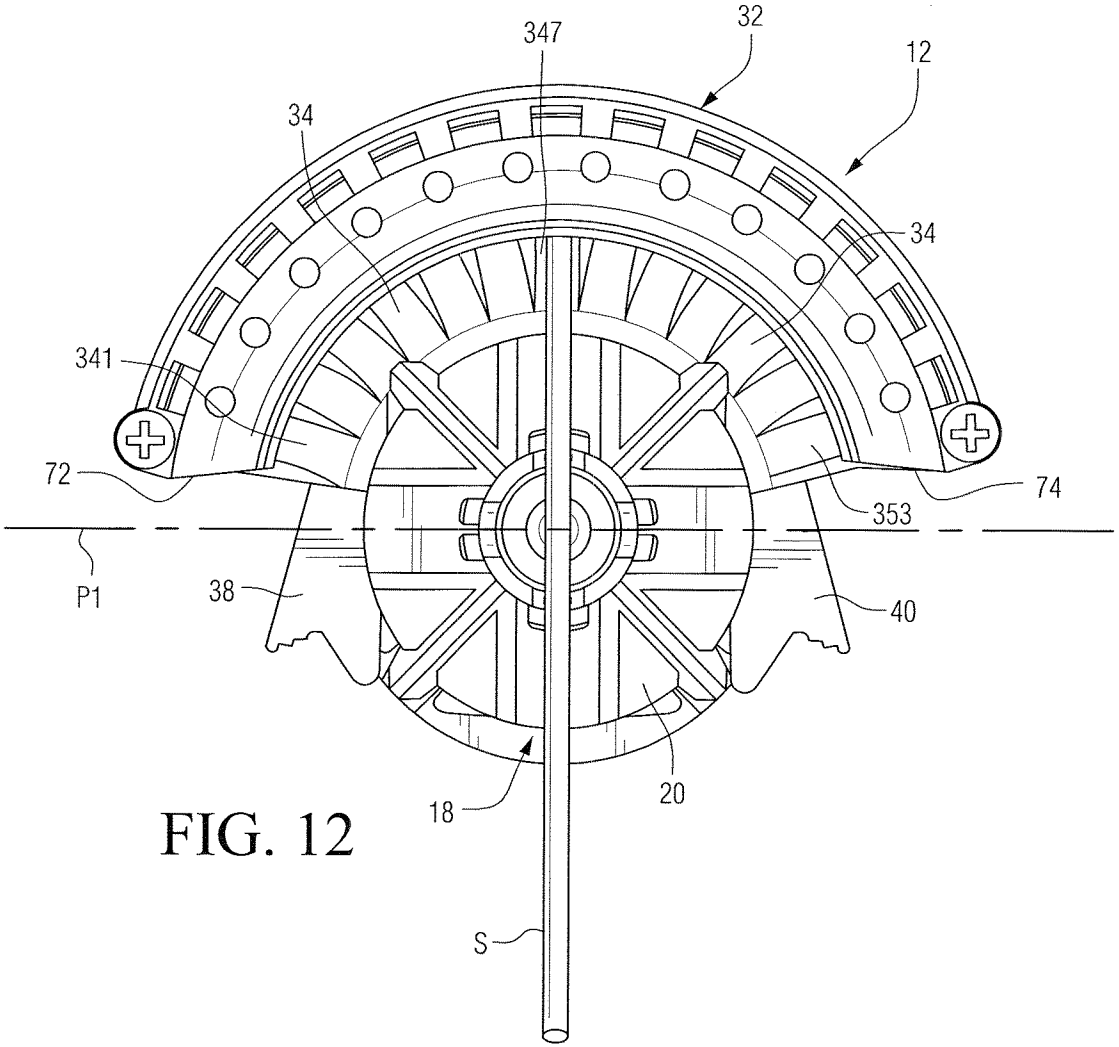
FIG. 12 is a top plan view similar to FIG. 11 but showing the stream at the mid-point of the deflector and redirected across the sprinkler axis and substantially perpendicular to a plane extending across the front of the deflector.

FIG. 12 shows the stream rotated further in the clockwise direction to the groove 347 where the exit angle is zero degrees. As a result, the stream both enters and exits the groove substantially along the plane P2. It will be understood of course, that the area between the stream as shown in FIG. 11 and the stream as shown in FIG. 12 will be filled in uniformly as the stream enters and exits each of the grooves between groove 341 and 347.

Figure 13:
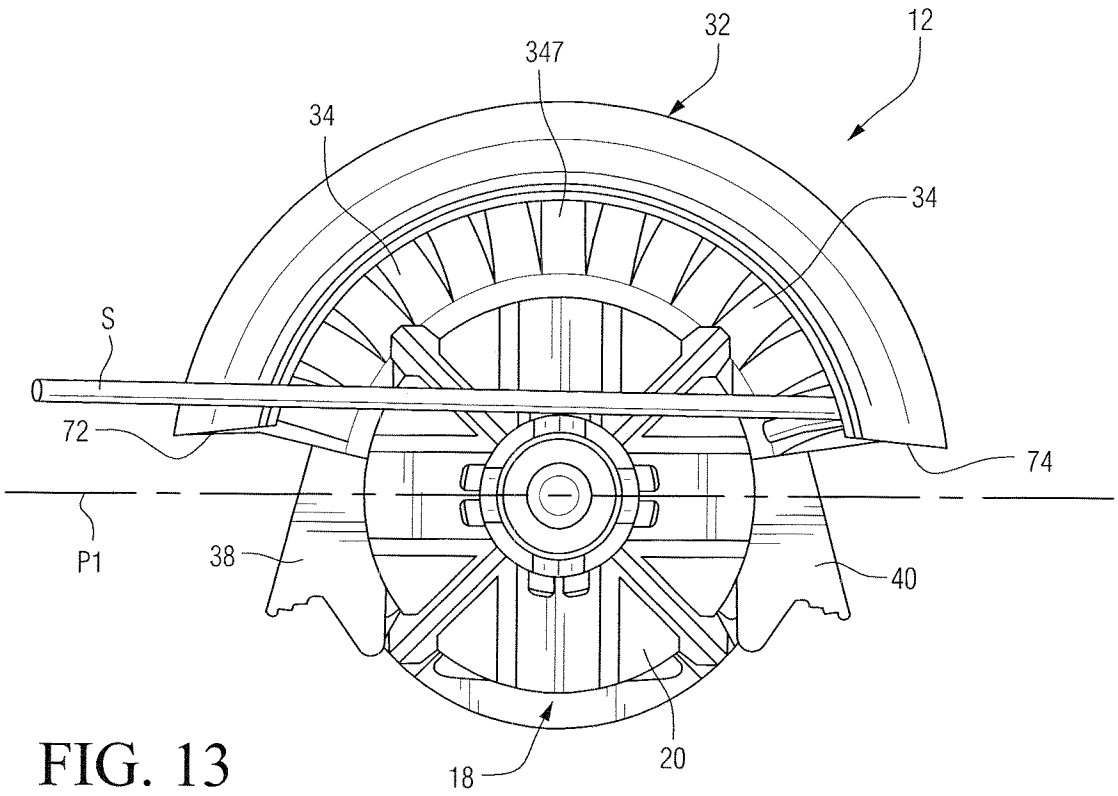
FIG. 13 is a top plan view similar to FIG. 12 but showing the stream exiting the last groove at the outlet side of the deflector, and redirected across the inlet side of the deflector.

FIG. 13 shows the stream S entering and exiting the last groove 353, and because of the mirror-image groove configuration on opposite sides of the plane P2, the stream S is redirected across the sprinkler, behind the plane P1 and slightly behind the inlet side edge 72.

Figure 14:
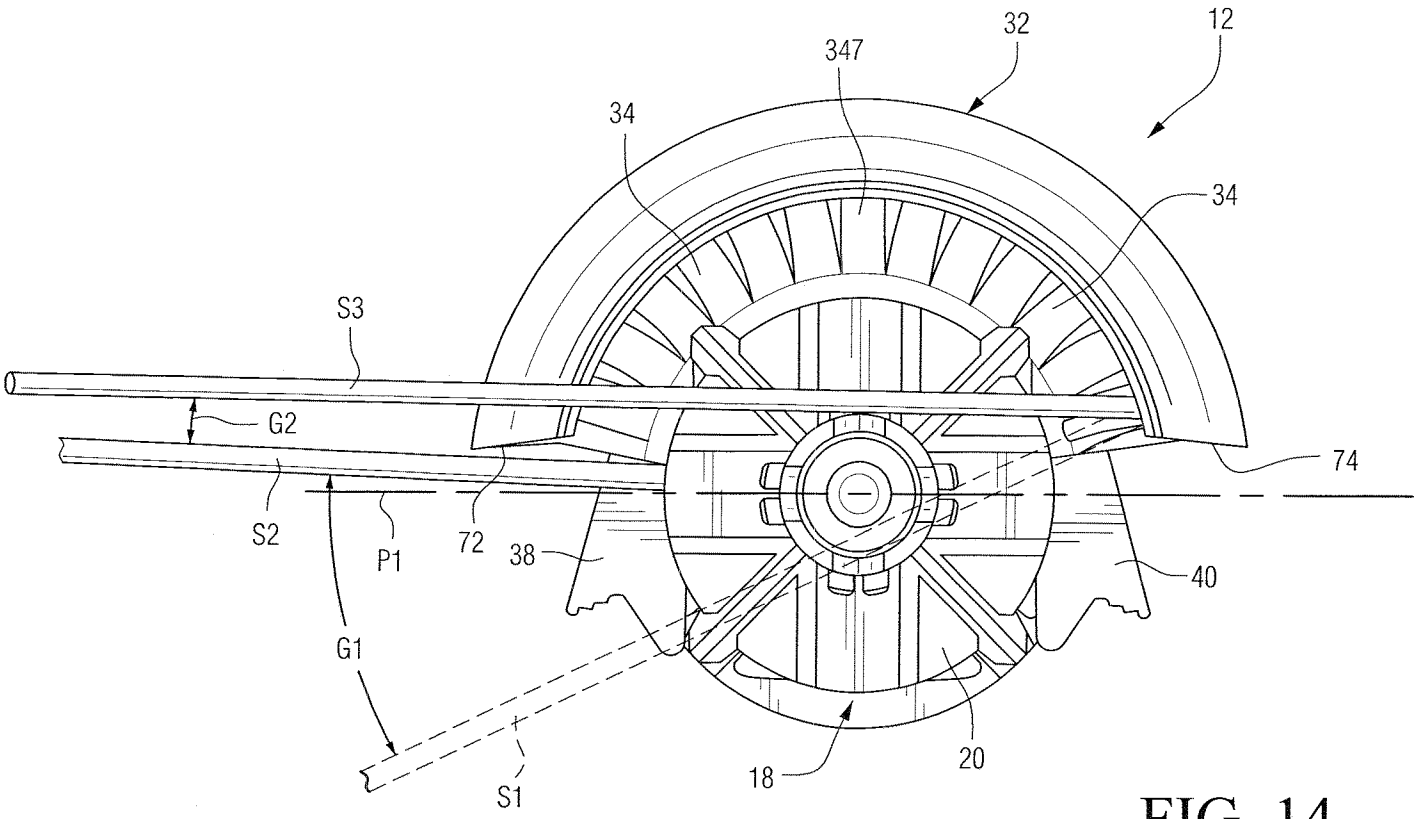
FIG. 14 is a plan view similar to FIG. 13 but also showing, for comparison purposes, an exit stream emitted by a known deflector device.

By way of comparison, FIG. 14 shows how a stream S1 is redirected from the last groove in the prior deflector construction. Stream S2 represents the stream location as it enters the deflector. It can be seen that a wedge-shaped gap G1 is created between the streams S1 and S2 that is underwatered. The stream S3 represents the stream redirected from the last groove 353 in accordance with the exemplary embodiment of this invention, greatly reducing the underwatered gap from G1 to G2.

Variations in the described deflector are contemplated, depending on the associated sprinkler construction and the desired sprinkling pattern. For example, the groove shapes in the upper portion 84 of the deflector may be altered to achieve a specific pattern, and the separable nature of the upper portion provides a simple and relatively inexpensive vehicle for implementing such variations.

In addition, the manner in which the upper and lower portions 84 and 86 are joined may also vary to include any suitable attachment mechanism. Similarly, the manner of attachment of the deflector to the sprinkler may be adapted to suit different sprinklers.

While the invention has been described in connection with what is presently considered to be the most practical and preferred embodiment, it is to be understood that the invention is not to be limited to the disclosed embodiment, but on the contrary, is intended to cover various modifications and equivalent arrangements.

What is claimed:

1. A stream deflector for a sprinkler comprising:

a generally concave, shell-shaped body having a generally semi-circular shape in plan, with opposite inlet and outlet side edges, said body extending outwardly and upwardly from a base at a lower end and then upwardly and inwardly to a distal, arcuate edge at an upper end, with a maximum radius between said base and said distal, arcuate edge; an inside surface of said shell-shaped body formed with a plurality of grooves between said inlet side edge and said outlet side edge, extending in a generally radial direction with entry ends adjacent said base and exit ends at said distal, arcuate edge; and wherein said grooves are formed with circumferential exit angles that vary substantially uniformly in opposite directions from a center one of said plurality of grooves to first and last of said plurality of grooves at said opposite inlet and outlet side edges, respectively, each of said circumferential exit angles representing an angle at which a stream is redirected as the stream exits a respective groove of the plurality of grooves.

2. The stream redirecting device of claim 1 wherein said exit angles are greatest for said first and last grooves.

3. The stream redirecting device of claim 2 wherein said exit angle for said center groove is zero.

4. The stream redirecting device of claim 1 wherein the deflector is divided into separable upper and lower portions.

5. The stream redirecting device of claim 2 wherein the circumferential exit angles of said first and last grooves are adapted to redirect a stream emitted from a sprinkler back across the deflector, behind said outlet and inlet side edges, respectively.

6. The stream redirecting device of claim 4 wherein the upper and lower portions are joined at a seam comprising an outwardly facing shoulder.

7. The stream redirecting device of claim 1 wherein each groove except said center groove has compound-curved sides that vary as a function of said exit angles.

8. The stream redirecting device of claim 1 wherein said base includes a pair of flexible arms extending substantially horizontally away from said shell-shaped body, said arms provided with attachment tabs.

9. The stream redirecting device of claim 7 wherein each groove except said center groove, curves in one direction proximate its entry end and then in an opposite direction to set the exit angle at its exit end.

10. A sprinkler comprising:

a housing assembly supporting a rotatable spray plate provided with a stem adapted to emit a stream in a substantially radially outward and upward direction when said spray plate rotates about an axis; and a stationary stream deflector separably mounted on said housing assembly, the stream deflector having a shell-shaped body having a generally semi-circular shape in plan, with opposite inlet and outlet side edges, said body extending outwardly and upwardly from a base at a lower end and then upwardly and inwardly to a distal, arcuate edge at an upper end, and having a maximum radius between said base and said distal, arcuate edge; an inside surface of said shell-shaped body formed with a plurality of grooves extending substantially radially between said inlet side edge and said outlet side edge, with entry ends adjacent said base and exit ends at said distal, arcuate edge; said entry ends of said grooves located to sequentially receive the stream emitted from the spray plate as the spray plate rotates about said axis; and wherein said grooves are formed with circumferential exit angles that vary substantially uniformly in opposite directions from a center one of said plurality of grooves to first and last of said plurality of grooves at said opposite inlet and outlet side edges, respectively, said circumferential exit angles representing an angle at which the stream is redirected as the stream exits a respective groove of the plurality of grooves.

11. The sprinkler of claim 10 wherein said exit angles are greatest for said first and last grooves.

12. The sprinkler of claim 11 wherein said exit angle for said center groove is zero.

13. The sprinkler of claim 10 wherein the deflector is divided into separable upper and lower portions.

14. The sprinkler of claim 11 wherein the circumferential exit angle of said first groove is adapted to redirect a stream emitted from a sprinkler back across the deflector, behind said outlet side edge.

15. The sprinkler of claim 11 wherein the circumferential exit angle of said last groove is adapted to redirect a stream emitted from a sprinkler back across the deflector, behind said inlet side edge.

16. The sprinkler of claim 14 wherein the circumferential exit angle of said last groove is adapted to redirect a stream emitted from a sprinkler back across the deflector, behind said inlet side edge.

17. The sprinkler of claim 13 wherein the upper and lower portions are joined at a seam comprising an outwardly facing shoulder.

18. The sprinkler of claim 10 wherein each groove except said center groove has compound-curved sides that vary as a function of said exit angles.

19. The sprinkler of claim 10 wherein said base includes a pair of flexible arms extending substantially horizontally away from said shell-shaped body, said arms provided with attachment tabs.

20. A stream deflector for a sprinkler comprising a substantially concave shell-shaped body provided with a plurality of generally radially-extending grooves between inlet and outlet side edges of the shell-shaped body, wherein said generally radially-extending grooves are formed with circumferential exit angles that vary in opposite directions from a center one of said plurality of grooves, said circumferential exit angles representing an angle at which a stream is redirected as the stream exits a respective groove of the plurality of generally radially-extending grooves, and wherein at least a first and last of said generally radially-extending grooves are shaped to redirect streams back across the shell-shaped body, substantially parallel to a vertical plane extending across said shell-shaped body, adjacent, and substantially equally spaced from, said inlet and outlet side edges.

* * * * *